United States Patent [19]

Gebel et al.

[11] 4,424,427

[45] Jan. 3, 1984

[54] VACUUM SWITCH

[75] Inventors: Rudolf Gebel; Lothar Schmidt, both of Erlangen, Fed. Rep. of Germany

[73] Assignee: Siemens Aktiengesellschaft, Munich, Fed. Rep. of Germany

[21] Appl. No.: 396,384

[22] Filed: Jul. 8, 1982

[30] Foreign Application Priority Data

Jul. 22, 1981 [DE] Fed. Rep. of Germany ..... 3129020

[51] Int. Cl.[3] ..... H01H 33/00

[52] U.S. Cl. ..... 200/144 B; 200/304

[58] Field of Search ..... 200/144 B, 304, 305

[56] References Cited

U.S. PATENT DOCUMENTS 3,764,764 10/1973 Takasuna et al. ..... 200/144 B
3,849,617 11/1974 Pflanz ..... 200/144 B
4,149,050 4/1979 Gorman et al. ..... 200/144 B

*Primary Examiner*—Elliot A. Goldberg

*Assistant Examiner*—Morris Ginsburg

*Attorney, Agent, or Firm*—Kenyon & Kenyon

[57] ABSTRACT

A vacuum switch of the type having contact electrodes which are coaxially movable with respect to each other for interrupting large currents. In one embodiment where a substantially cylindrical housing is arranged around the contacts, a radially inward bulge of metallic material is arranged near a center plane intermediate of the contacts. Such a bulge may be formed by inserting a metallic, annular insert within the housing, or producing an annular bulge in the housing itself. The bulge produces an inclination which is selected so that a plasma which flows from the arc which is produced upon interruption of the current is deflected in the axial direction. Such deflection reduces the stress on the vapor shield and is particularly advantageous with single-pulse switches which experience relatively long arcing times.

3 Claims, 1 Drawing Figure

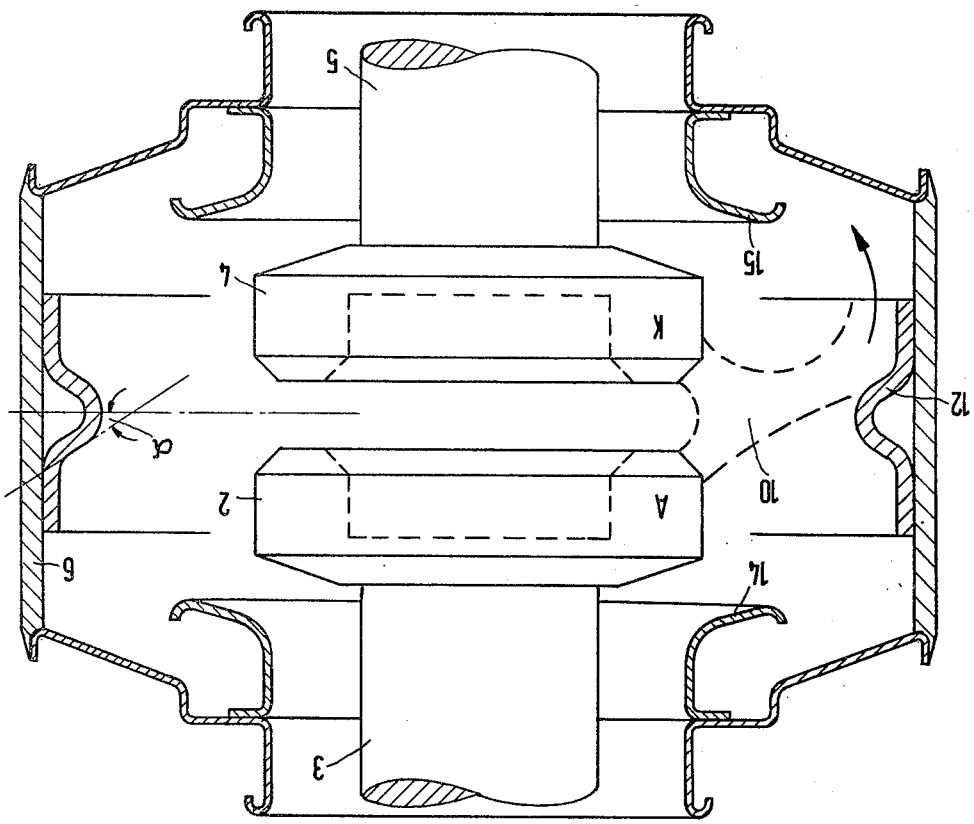
3
14
6
2
A
10
α
12
K
4
15
5

VACUUM SWITCH

BACKGROUND OF THE INVENTION

This invention relates generally to vacuum switches, and more particularly to a vacuum switch of the type having contacts which are movable with respect to each other and which include a vapor shield.

In conventional vacuum switches, current generally flows through contacts which are arranged coaxially with respect to one another, and in a high vacuum. A rotationally symmetrical housing is provided for containing the high vacuum environment, and may be formed of a material which is essentially electrically insulating, such as ceramic. Current flowing through the switch is interrupted by separating the contacts. Such separation of the contacts produces an arc which is generated in the region between the separated contacts; the base points of which arcing causing metal to evaporate from the surface of the contacts. The metal vapor flows outward and is condensed at a vapor shield which is formed to have substantially the same shape as a hollow cylinder and is arranged at a predetermined distance from the inside wall of the housing. In some situations, vacuum switches are required to interrupt short-circuit currents which have a high intensity, for example, greater than 40 kA, thereby producing a relatively long arcing time of more than 10 ms. Such intensive arcing can start at the two electrodes and the vapor shield, possibly causing the melting of the vapor shield. One known vacuum circuit interrupter which is subject to this effect is described in U.S. Pat. No. 4,149,050.

In some known vacuum switches, the housing may be formed of metal, illustratively stainless steel, in the region between the opened contacts. This middle portion of the housing, which is shaped essentially as a hollow cylinder, is in mechanical contact with the electrodes through further parts of the housing which are formed of electrically insulating material. As described in U.S. Pat. No. 3,764,764, such electrically insulating parts may be provided with shielding. In such an arrangement, the metallic portion of the housing surrounding the region between the opened contacts assumes the function of a vapor shield.

In this known arrangement, when a large current is interrupted so as to produce a large arcing current having a relatively long arcing time, the arc starts near the outer edge of the contacts and jumps to the vapor shield. The plasma jet which starts at the center of the arc is directed toward the vapor shield and is inclined somewhat toward the cathode of the electrodes, such that large stresses occur on the vapor shield at approximately the height of the cathode surface resulting in the possible melting of the shield.

It is, therefore, an object of this invention to provide an improved vacuum switch wherein an insulating material or a metal housing has greater resistance to melting through at the vapor shield, thereby increasing the life of the vacuum switch.

SUMMARY OF THE INVENTION

The foregoing and other objects are achieved by this invention which provides a vacuum switch having contacts which are movable with respect to one another, and a vapor shield. A radially inward curvature in the form of a bulge is provided near the center plane between the opened contacts.

In embodiments of the invention wherein a metallic housing is provided for the vacuum switch, the area of the metallic housing which surrounds the opened electrodes may itself be curved to form the annular bulge. Alternatively, the inner wall of the housing may be provided with an annular insert having a rotationally symmetrical profile so as to produce the curvature at the center plane between the opened contacts. With respect to the position of the contacts, the bulge of the annular insert appears to have inclined flanks with respect to the center plane between the opened contacts. Such flanks deflect the plasma jet flow upward and/or downward along the axial direction. This effect reduces the stress on the vapor shield in this central region.

BRIEF DESCRIPTION OF THE DRAWING

Comprehension of the invention is facilitated by reading the following detailed description in conjunction with the annexed drawing which shows in schematic form an illustrative embodiment of a vacuum switch constructed in accordance with the principles of the invention.

DETAILED DESCRIPTION

The figure shows an embodiment of the inventive vacuum switch having two electrodes 2 and 4 which are arranged coaxially movable with respect to each other. Each such electrode may be formed as a cup contact and is connected to a respective one of current leads 3 and 5. The electrodes are surrounded by a housing 6 having a shape which is essentially cylindrical at the portion of the housing which surrounds the area of opened contacts 2 and 4. The housing is formed of a metallic material, preferably stainless steel. Housing 6 is provided with electrically insulating portions (not shown), which are used in the formation of a vacuum-tight joint with current leads 3 and 5.

An interruption of the current is initiated by moving contacts 2 and 4 apart so as to form between their contact surfaces an annular gap which is not specifically designated in the figure. As noted, this embodiment of the invention is useful in situations where arcing is maintained for a relatively long period of time. The arcing generally begins at the outer edge of the contact surfaces, and a plasma jet which begins approximately from the center of the arc is directed toward housing 6. Such an arcing-induced plasma jet causes the housing to become heated in this area. Depending upon the polarity of the AC current which is to be extinguished, one of the electrodes performs as an anode, and the other as a cathode. During half waves, for example, where electrode 2 performs as an anode A, the plasma jet is inclined toward electrode 4 which performs as a cathode K. In this mode of operation, the stress on housing 6 is increased at a height along the housing which is near the contact surface of cathode K.

In accordance with the present invention, the stress on housing 6 while it operates as a vapor shield is reduced by providing an annular insert 12 on the inside wall of housing 6. Annular insert 12 forms a rotationally symmetrical body which surrounds the region between open contacts 2 and 4. The insert is provided with a bulge which is directed radially inward and which is arranged approximately in the center plane between contacts 2 and 4. In operation, the plasma jet which begins from an arc 10 is deflected, illustratively downward, depending upon the polarity of the half wave of the AC current. Such deflection reduces the stress on housing 6 and produces a corresponding increase in the life of the vacuum switch. In addition to deflecting the plasma jet flow, insert 12 supplies a reserve of additional material for the burn-off. In one embodiment, insert 12 may be formed of stainless steel, particularly chrome steel. Alternatively, the insert may be formed of substantially oxygen-free copper which has a high thermal conductivity. In one embodiment, insert 12 may be produced in its profiled form by extrusion, and the insert can be spot-soldered or welded to the inside wall of housing 6.

In some embodiments it may be advantageous to provide a pair of material collecting baffles 14 and 15. These baffles collect melted-off shield material which is discharged in the direction of the plasma jet flow which is indicated by an arrow in the drawing. The use of such baffles prevents the formation of a bridge between electrically conductive housing parts and current leads 3 and 5.

As noted, the specific illustrative embodiment of the inventive vacuum switch which is shown in the drawing is provided with a separate insert 12 within housing 6. In other embodiments, however, it may be advantageous to provide a radially inward bulge directly in housing 6 near the center plane between opened electrodes 2 and 4. Such a bulge would deflect the plasma flow and reduce the stress on the housing.

As noted, irrespective of whether a separate vapor shield, such as insert 12, is provided within the housing, the inward curvature of the bulge is selected so that there is not provided a substantial field strength which would reduce substantially the dielectric strength of the switch. The inclination of the falling flanks of the curvature is selected so that good deflection of the plasma flow is achieved as indicated by the arrow in the figure. An advantageous deflection characteristic has been obtained where an angle of inclination $\alpha$ is illustratively between 30° and 60° with respect to a center plane of the vacuum switch, and preferably between 40° and 55°.

Although the invention has been described in terms of a specific embodiment for specific applications, persons skilled in the art, in light of this teaching, can produce additional embodiments without exceeding the scope or departing from the spirit of the claimed invention. Accordingly, it is to be understood that the drawing and descriptions in this disclosure are proffered to facilitate comprehension of the invention and should not be construed to limit the scope thereof.

What is claimed is:

1. A vacuum switch of the type having a housing and contacts which are arranged therein to be movable with respect to each other, the vacuum switch further comprising;

vapor shield means having an inwardly directed bulge, said bulge being arranged near a center plane between the contacts and having a predetermined angle of inclination adapted to deflect along a predeterminable path a plasma jet flow resulting from arcing across the contacts; and baffle collector means attached to the housing and arranged in said predeterminable path for collecting particles removed from said vapor shield means by said plasma jet flow.

2. The vacuum switch of claim 1 wherein there is further provided metallic housing means, said metallic housing means being provided with said inwardly directed bulge.

3. The vacuum switch of claim 2 wherein there is further provided an annular insert arranged within said metallic housing for forming said bulge, said bulge having an annular configuration.

* * * * *